US007866515B1

(12) United States Patent
Buis, III et al.

(10) Patent No.: US 7,866,515 B1
(45) **Date of Patent: *Jan. 11, 2011**

(54) PADDLE PLATFORM

(75) Inventors: Charles E. Buis, III, Virginia Beach, VA (US); Thomas M. Gregory, Belgrade, MT (US); Robert A. Kincaid, Bozeman, MT (US); Eric M. Yeates, Virginia Beach, VA (US); Clifton L. Cook, Boise, ID (US); David C. Alstrom, Belgrade, MT (US); Bruce A. Schilling, Belgrade, MT (US); Thomas A. Marx, Virginia Beach, VA (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 708 days.

This patent is subject to a terminal disclaimer.

(21) Appl. No.: 11/906,628

(22) Filed: Oct. 3, 2007

Related U.S. Application Data

(63) Continuation-in-part of application No. 10/777,859, filed on Feb. 12, 2004, now Pat. No. 7,320,420.

(51) Int. Cl.
*F41C 33/02* (2006.01)

(52) U.S. Cl. ..... 224/197; 224/198; 224/667

(58) Field of Classification Search ..... 224/197, 224/667, 272, 198
See application file for complete search history.

(56) References Cited

U.S. PATENT DOCUMENTS 3,589,574 A * 6/1971 Marburger ..... 224/672
5,265,781 A * 11/1993 Nichols ..... 224/198
5,544,794 A * 8/1996 Nichols ..... 224/667
5,551,611 A * 9/1996 Gilmore ..... 224/198
5,875,944 A * 3/1999 Beletsky ..... 224/198
6,010,045 A * 1/2000 Rogers et al. ..... 224/198
6,588,639 B2 * 7/2003 Beletsky et al. ..... 224/672
6,588,640 B1 * 7/2003 Rogers et al. ..... 224/673
D507,104 S * 7/2005 Gregory et al. ..... D3/222
D508,318 S * 8/2005 Gregory et al. ..... D3/222
D528,786 S * 9/2006 Parsons ..... D3/229
7,210,604 B2 * 5/2007 Kostal et al. ..... 224/200
7,320,420 B2 * 1/2008 Buis et al. ..... 224/197
7,331,872 B1 * 2/2008 Parsons ..... 463/47.2
D567,707 S * 4/2008 Yeates et al. ..... D11/200
2004/0134945 A1 * 7/2004 Kincaid et al. ..... 224/269
2004/0188477 A1 * 9/2004 Parsons ..... 224/251
2007/0235481 A1 * 10/2007 Parsons ..... 224/197

* cited by examiner

*Primary Examiner*—Justin M Larson
(74) *Attorney, Agent, or Firm*—Bowman Green Hampton & Kelly, PLLC

(57) ABSTRACT

A paddle for securing at least one holster or accessory carrier at a desired attitude, the paddle including an attachment plate, a first arcuate slot defined through the attachment plate, a second arcuate slot defined through the attachment plate, a compound slot defined through the attachment plate below the first and second slots, wherein fastening means are capable of engaging points of attachment defined on a holster or accessory carrier, and wherein a relative angle of the holster or accessory carrier to the attachment plate is adjustable by coordinated adjustment of the fastening means within each of the first arcuate slot, the second arcuate slot, and the compound slot.

23 Claims, 10 Drawing Sheets

Fig. 8
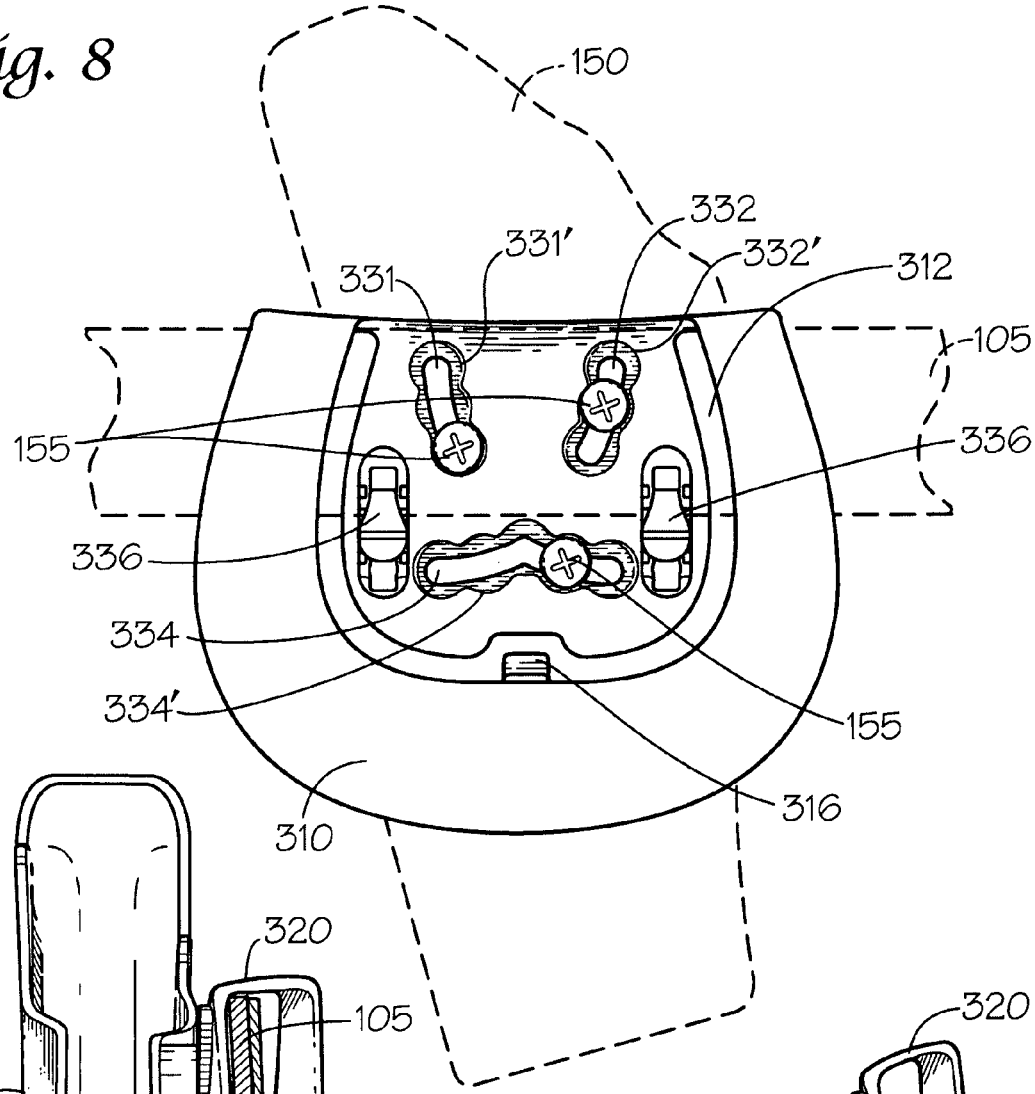
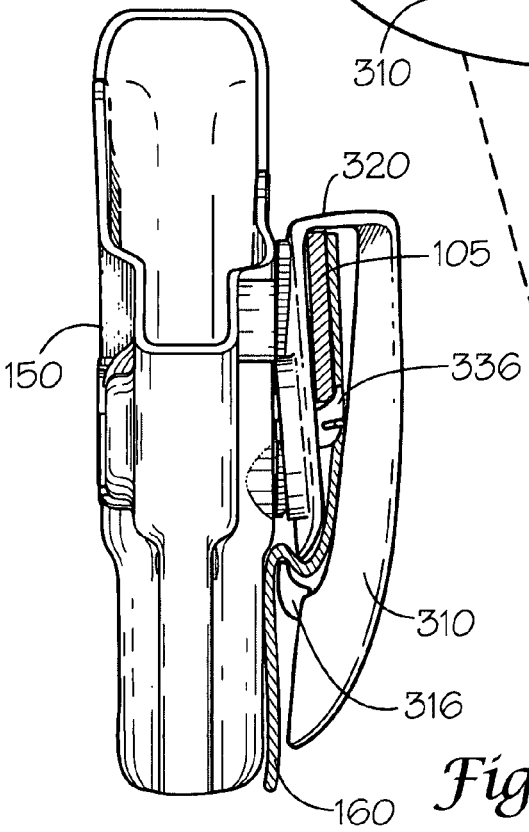
Fig. 9B
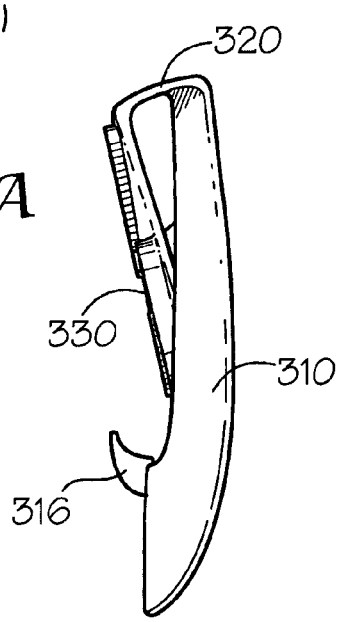
Fig. 9A

PADDLE PLATFORM

CROSS-REFERENCE TO RELATED APPLICATIONS

This is a Continuation-In-Part of U.S. patent application Ser. No. 10/777,859, filed Feb. 12, 2004, issued as U.S. Pat. No. 7,320,420 B2 on Jan. 8, 2008, the disclosure of which is incorporated herein by reference.

BACKGROUND OF THE INVENTION

1. Field of the Invention

The present invention is directed generally to a rigid or semi-rigid holder for attaching a handgun holster or other accessory carrier to a belt, a waistband of a pair of trousers, or other article of clothing. More specifically, the holder comprises a paddle platform that includes several adjustment points for changing an angle between the paddle platform and a holster or other accessory carrier attached to the paddle.

2. Description of Related Art

There are several types of holster holding devices. For example, U.S. Pat. No. 5,544,794 to Nichols discloses a holster with a hanger device. The hanger device is arranged with bolts such that the height of the holster may be easily adjusted by loosening the bolts and moving the holster body up or down relative to the hanger device. After a desired position has been reached, the bolts are tightened to hold the holster at the desired height.

U.S. Pat. No. 5,551,611 to Gilmore discloses a variable position handgun holster with a belt plate and a back plate. The handgun holster may be adjusted longitudinally and radially with respect to the belt plate. The back plate may be adjusted transversally to the belt plate.

U.S. Pat. No. 6,588,639 to Beletsky et al. discloses a molded holster belt loop assembly with a shelf. The belt loop assembly includes a tapered belt loop opening and a platform upon which the belt rests.

SUMMARY OF THE INVENTION

The prior holster holders are not simple to adjust, easy to maintain, or cost effective to produce. The prior holster holders fail to provide a user with an ability to readily position a holster or other attached accessory carrier at a desired angle. Furthermore, the prior holster holders fail to provide a raised or other protrusion or surface preparation that aids in maintaining the holster holder in a desired position relative to a user's garment.

Accordingly, the present invention is directed generally to a rigid or semi-rigid holder usable for attaching a handgun holster or other accessory carrier to a belt, a waistband of a pair of trousers, or other article of clothing. More specifically, the holder comprises a paddle platform that includes several adjustment points that allow a relative angle between the paddle platform and an attached holster or other accessory carrier to be changed.

In various exemplary, non-limiting embodiments of this invention, the holder comprises a "clip-on" plate or paddle having a biased portion with an extension for securing the paddle to a user's belt, waistband, or other article of clothing. The paddle includes a generally U-shaped slot for accommodating a belt, waistband, other article of clothing, or the like to secure the paddle thereto.

In various exemplary embodiments, the holster holder, or paddle, comprises two arcuate slots and a recurvate, compound slot, which are capable of receiving fastening means for securing the paddle to the holster or other accessory carrier in an adjustable fashion.

In various exemplary embodiments, the holster holder, or paddle, comprises a plate, a first arcuate slot defined through the plate, wherein the first arcuate slot is capable of allowing a first fastening means to extend therethrough, a second arcuate slot defined through the plate, wherein the second arcuate slot is capable of allowing a second fastening means to extend therethrough, a third slot defined through the plate below the first and second slots, the third slot comprising a compound slot formed by the intersection of two arcuate slots, wherein the arc centers of the two arcuate slots are located above the compound slot, wherein a point of intersection of the two arcuate slots forms the highest point of the compound slot, and wherein the third slot is capable of allowing a third fastening means to extend therethrough, wherein the three fastening means are capable of engaging three points of attachment defined on a holster, and wherein a relative angle of the holster to the plate is infinitely adjustable by coordinated adjustment of the three fastening means within each of the three slots.

Thus, in certain exemplary embodiments, a holster or other accessory carrier may be turned or rotated with respect to the paddle to allow a user to adjust the angle of the holster relative to the wearer. Thus, for example, the wearer may adjust an attached holster such that the grip of a handgun contained within the holster is positioned at a desired angle relative to the wearer.

In various exemplary, non-limiting embodiments of this invention, a holster or other accessory carrier may be adjustably rotated or turned to change an angle at which the holster or other accessory carrier is held relative to the attached article of clothing, and attached to the paddle at that angle. That is to say, an angle between the paddle and the holster or other accessory carrier may be adjusted between several determined adjustment points. For example, the angle between a holster and a user's belt may be adjusted between several determined adjustment points.

In various exemplary, non-limiting embodiments of this invention, the paddle includes certain permanently and/or repositionably attached protrusions that help to maintain the paddle in a desired relationship with a user's belt, waistband, or other article of clothing.

Thus, the present invention comprises a new and improved paddle platform that allows a holster or other accessory carrier to be attached to the paddle at a number of determined angles relative to the paddle.

Accordingly, this invention provides a paddle, having a simple and reliable holster or accessory carrier attachment system.

This invention separately provides a paddle that includes an attachment plate with a plurality of adjusting points for allowing a holster or other accessory carrier to be positioned at a desired angle relative to the attachment plate.

This invention separately provides a paddle, which is capable of being manufactured using injection molding and/or thermoform production techniques.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein:

FIG. 8 shows a rear elevation view of the third exemplary embodiment of a paddle according to this invention, wherein an exemplary holster is attached to the exemplary paddle and the exemplary paddle is attached to an exemplary belt, as illustrated in phantom with broken lines;

FIG. 9A shows a right side elevation view of the third exemplary embodiment of a paddle according to this invention;

FIG. 9B shows a right side elevation view of the third exemplary embodiment of a paddle according to this invention, wherein an exemplary holster is attached to the exemplary paddle and the exemplary paddle is attached to an exemplary belt and trousers;

DETAILED DESCRIPTION OF EXEMPLARY EMBODIMENTS

Figure 1:
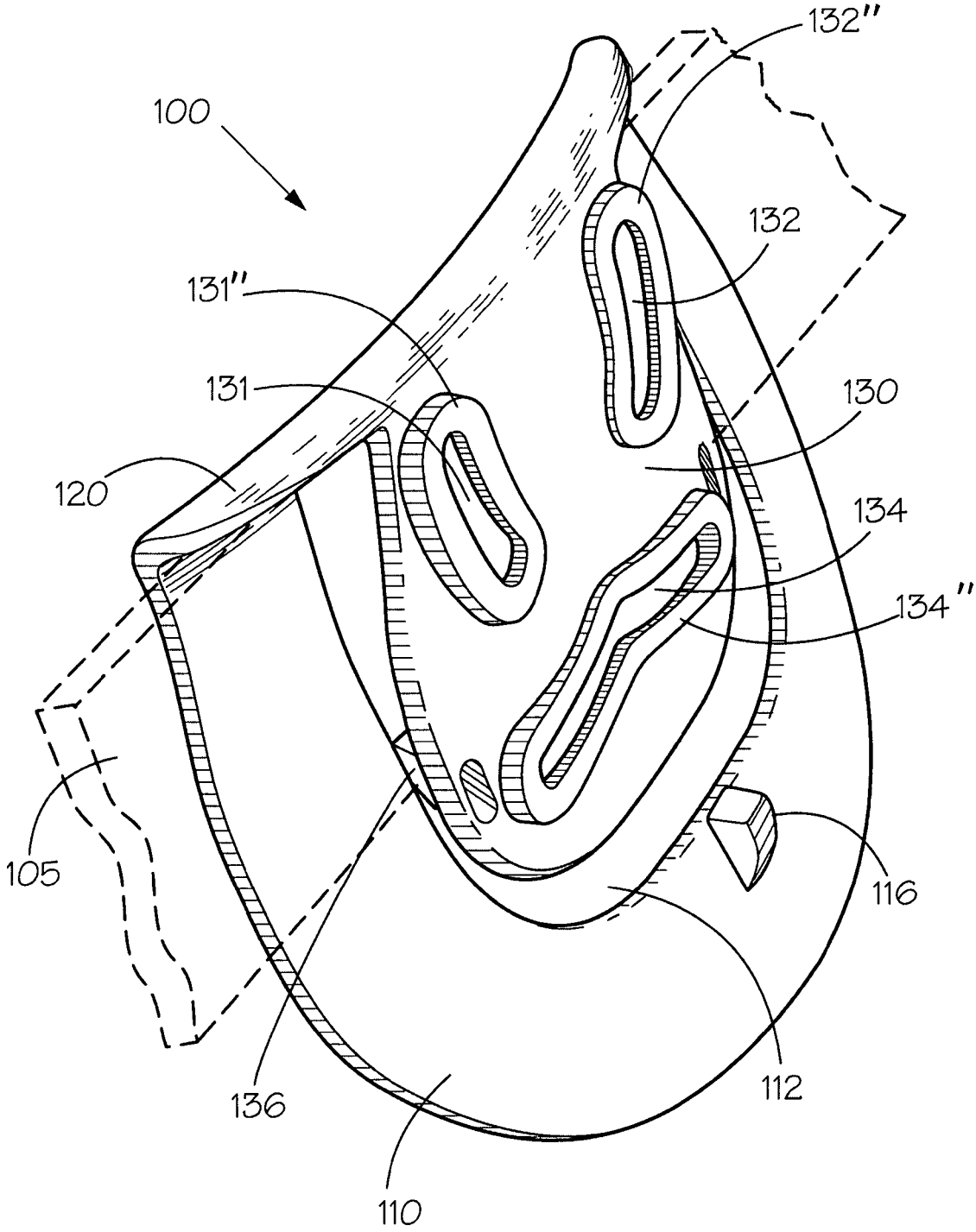
FIG. 1 shows a front perspective view of a first exemplary embodiment of a paddle according to this invention.

For simplicity and clarification, the design factors and operating principles of the paddle according to this invention are explained with reference to various exemplary embodiments of a paddle according to this invention. The basic explanation of the design factors and operating principles of the paddle is applicable for the understanding, design, implementation, and operation of the paddle of this invention.

It should be appreciated that, for simplicity and clarification, the embodiments of this invention will be described and shown with reference to a handgun holster being attached to the present paddle. However, it should be appreciated that a handgun holster is just one type of accessory carrier that may be attached to the paddle, and one or more other accessory carriers (i.e., a magazine pouch, flashlight holder, Picatinny-type mounting rail, or the like) or mounting devices (i.e., a Picatinny-type mounting rail) may be attached to the paddle in place of or in addition to a holster.

Finally, it should be appreciated that the terms "holder", "paddle", "holster", and "accessory carrier" are used for basic explanation and understanding of the operation of the systems, methods, and apparatuses of this invention. Therefore, the terms "holder", "paddle", "holster", and "accessory carrier" are not to be construed as limiting the systems, methods, apparatuses, or applications of this invention.

FIGS. 1-3B show various views of a first, illustrative, non-limiting embodiment of a paddle 100 according to this invention. It should be appreciated that various exemplary embodiments of the paddle 100 are described and shown with reference to a handgun holster 150 (holster 150 is depicted in phantom with broken lines in FIGS. 2A, 2B, 2C, and in FIG. 8) being attached to the paddle 100. However, it should be appreciated that one or more other accessory carriers (not shown) or mounting devices (not shown) may be attached to the paddle 100 in place of or in addition to a holster 150.

As shown in FIGS. 1-3B, the first exemplary embodiment of the paddle 100 includes at least some of a paddle extension 110, a paddle bridge portion 120, and a paddle attachment plate 130. The paddle extension 110 and the paddle attachment plate 130 each comprise a first side wall and a second side wall. Typically, the first side wall is considered the outer side of the paddle 100 and is worn facing away from a user's body, while the second side wall is considered the inner side of the paddle 100 and is worn facing against or adjacent the user's body.

As illustrated in FIGS. 1-3B, the paddle extension 110 comprises a curved portion of material formed so as to conform or at least partially follow the curvature of a user's waist or hip structure. Typically, the paddle extension 110 includes rounded exterior edges, such that the paddle extension 110 may be comfortably positioned between a user's body and the user's waistband/belt 105, substantially beneath the wearers clothing 160 (i.e., the wearers pants or skirt).

It should be appreciated that while the paddle extension 110 is illustrated as having a somewhat oval overall shape, the overall size and shape of the paddle extension 110 is a design choice based upon the desired strength and/or functionality of the paddle 100. Thus, it should be understood that the overall size and shape of the paddle extension 110 may include any generally round, square, rectangular, triangular, oval, arcuate, or other shape.

In various exemplary embodiments, the paddle extension 110 includes a skeletonized portion 112. If included, the skeletonized portion 112 comprises an aperture or void formed in the paddle extension 110. While the size and shape of the skeletonized portion 112 is a design choice based on the desired appearance and functionality of the paddle 100, the skeletonized portion 112 may be formed so as to allow at least a portion of the paddle attachment plate 130 to extend into the skeletonized portion 112 (as seen in FIGS. 1 and 3A).

In various exemplary embodiments, the paddle extension 110 also includes at least one paddle projection 116. As illustrated in FIGS. 1-3B, the paddle projection 116 extends from the first side wall of the paddle extension 110 in the form of a catch or barb that provides a degree of additional resistance to the removal of the paddle 100 once the paddle 100 has been attached to a user's belt, waistband, or other article of clothing.

The paddle bridge portion 120 joins the paddle extension 110 to the paddle attachment plate 130 and provides sufficient space between the paddle extension 110 and the paddle attachment plate 130 to allow at least a belt 105 and/or waistband to fit between at least an upper portion of the paddle extension 110 and the paddle attachment plate 130.

In various exemplary embodiments, the paddle bridge portion 120 may comprise integrally formed, extended portions of the paddle extension 110 and the paddle attachment plate 130. Alternatively, the paddle bridge portion 120 may comprise a separate component that is joined, attached, coupled, welded, or fused to join the paddle extension 110 to the paddle attachment plate 130.

In still other exemplary embodiments, the paddle extension 110 and the paddle attachment plate 130 may be formed of a single portion of material in which a substantially "U"-shaped slot is formed to define the paddle extension 110 and the paddle attachment plate 130. In these exemplary embodiments, the paddle bridge portion 120 may comprise a portion of the material that connects the paddle extension 110 to the paddle attachment plate 130.

Figure 3B:
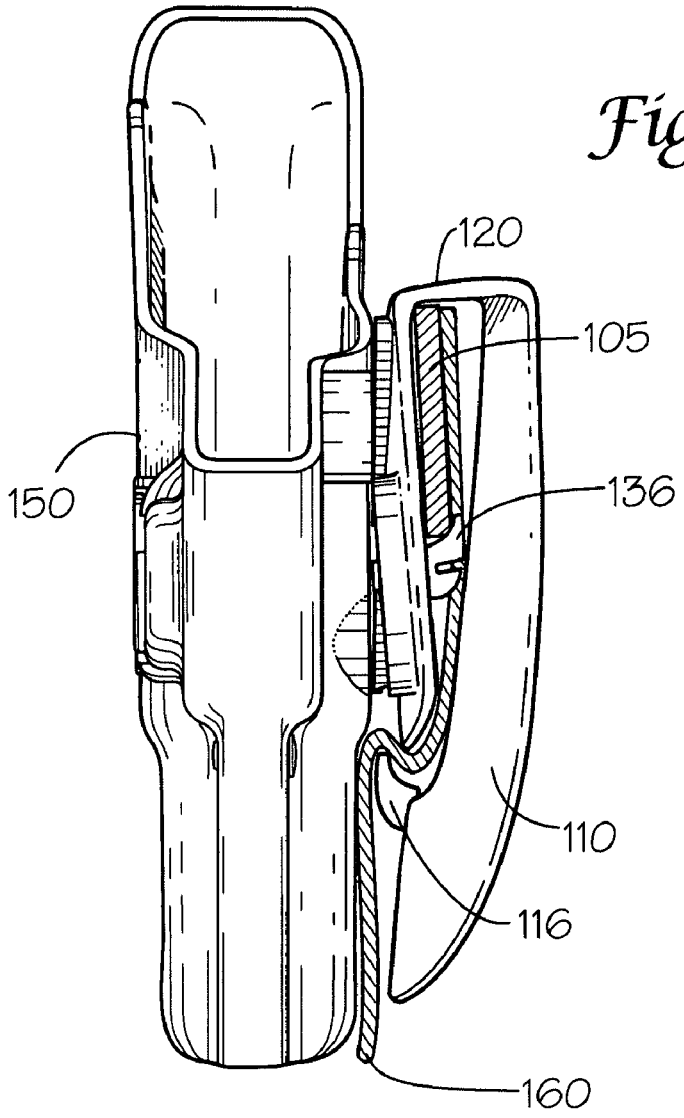
FIG. 3B shows a right side elevation view of the first exemplary embodiment of a paddle according to this invention, wherein an exemplary holster is attached to the paddle and the paddle is attached to an exemplary belt and trousers.
Figure 3A:
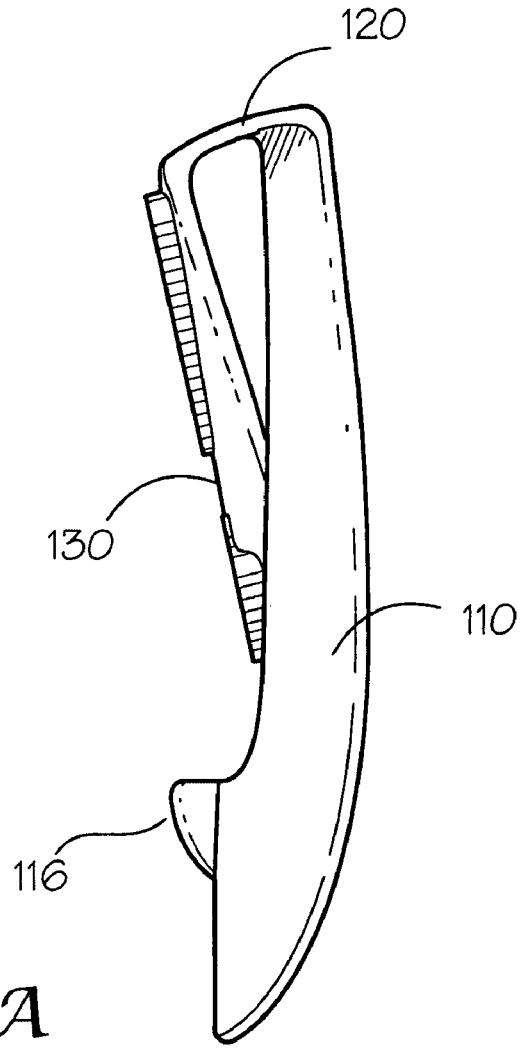
FIG. 3A shows a right side elevation view of the first exemplary embodiment of a paddle according to this invention.

As illustrated in FIGS. 3A-3B, in various exemplary embodiments, the paddle extension 110 is formed relative to the paddle attachment plate 130 in a spring biased manner, such that at least a portion of the paddle extension 110, the paddle bridge portion 120, and/or the paddle attachment plate 130 must be flexed in order for the paddle extension 110 to be positioned between a user's body and the user's waistband/belt. Once positioned between the user's body in a user's waistband/belt, the spring bias provides an additional degree of frictional attachment between the first side wall of the patent extension 110, the second side wall of the paddle attachment plate 130, and the user's waistband/belt.

As further illustrated in FIGS. 1-3B, the paddle attachment plate 130 comprises a curved portion of material formed so as to conform or at least partially conform to the curvature of a user's waist. In this manner, the paddle attachment plate 130 may attempt to follow the outer curvature of the user's belt 105 when paddle extension 110 is positioned between a user's belt 105 and the user's body.

In various exemplary embodiments, the paddle attachment plate 130 also includes at least one paddle locking protrusion 136. As illustrated in FIGS. 1-3B, the paddle protrusions 136 extend from the second side wall of the paddle attachment plate 130 so as to form catches or barbs that provide a degree of additional resistance to the removal of the paddle 100 once the paddle 100 has been attached to a user's belt, waistband, or other article of clothing.

The paddle attachment plate 130 further comprises a first arcuate slot 131, a second arcuate slot 131, and a compound slot 134 formed through the paddle attachment plate 130. Arcuate slots 131 and 132 are formed in an upper portion of the paddle attachment plate 130, and run in a substantially "V"-shaped fashion, essentially forming mirror images of one another.

The compound slot 134 is formed in a lower portion of the paddle attachment plate 130, and, as illustrated, has a recurvate form substantially similar to that of an arc that has been bent or curved backward or downward at its central vertical axis, such that the terminal ends of the arc touch spaced apart points on the same horizontal plane.

In various exemplary embodiments, the compound slot 134 has a shape created by some portion of the lower half of two circles of equal diameter and a common horizontal axis as they move inward from single point tangency to a position just short of complete overlapping with a single center and a common vertical axis. Thus, the compound slot 134 may be formed by two intersecting arcuate slots, wherein the arc centers of the arcuate slots are located on the same horizontal plane above the arcuate slots and at points equidistant from, and on opposite sides of, a bisecting vertical centerline, and wherein the radii of the arcuate slots are identical to one another and always greater than or equal to the respective distances between each center and the bisecting centerline and whose point of intersection forms the highest point of the compound slot 134 because the non-intersecting ends of each of the two arcuate slots always terminate when the non-intersecting ends intersect with the vertical centerline of their own centers.

In various exemplary embodiments, the compound slot 134 may be formed by the intersection of two arcuate slots, wherein the arc centers of the two arcuate slots are located above the compound slot 134, wherein a point of intersection of the two arcuate slots forms the highest point of the compound slot 134.

Furthermore, the shape and positional relationship of the arcuate slots 131 and 132 and the compound slot 134 is such that the arcuate slots 131 and 132 and the compound slot 134 are each capable of simultaneously interacting with a corresponding attachment point on the holster 150 and an appropriate fastener 155 to allow adjustment of the angular relationship between the paddle 100 and the holster 150.

In various exemplary embodiments, the shape and positional relationship of the arcuate slots 131 and 132 and the compound slot 134 may be such that only one of the arcuate slot 131 or the arcuate slot 132 is capable of simultaneously interacting with the compound slot 134 and corresponding attachment points on the holster 150 to allow adjustment of the angular relationship between the paddle 100 and the holster 150. For example, in these exemplary embodiments, the shape and positional relationship of the arcuate slots 131 and 132 and the compound slot 134 may be such that only the arcuate slot 131 and the compound slot 134 may be capable of simultaneously interacting with two corresponding attachment points on the holster 150 to allow adjustment of the angular relationship between the paddle 100 and the holster 150.

Each of the arcuate slots 131 and 132 and the compound slot 134 is formed so as to be capable of receiving a fastener 155, which passes therethrough for securing the holster 150 to the paddle attachment plate 130. The arcuate slots 131 and 132 and the compound slot 134, in cooperation with appropriate fasteners 155, allow a holster 150 (or any other accessory carriers or mounting devices) to be attached to the paddle attachment plate 130.

In various exemplary embodiments, the fasteners 155 may comprise screws, snap-together parts, or any other known or later developed means for removably attaching or coupling the paddle attachment plate 130 to cooperating attachment points (not shown) of the holster 150.

The fasteners 155 may be loosened or separated and the holster 150 may be rotated to assume a desired angle between the paddle attachment plate 130 and the holster 150. Once the holster 150 has been rotated to the desired angle, the fasteners 155 may be tightened, attached, or coupled so that the holster 150 may be maintained at the desired angle relative to the paddle attachment plate 130.

Figure 2A:
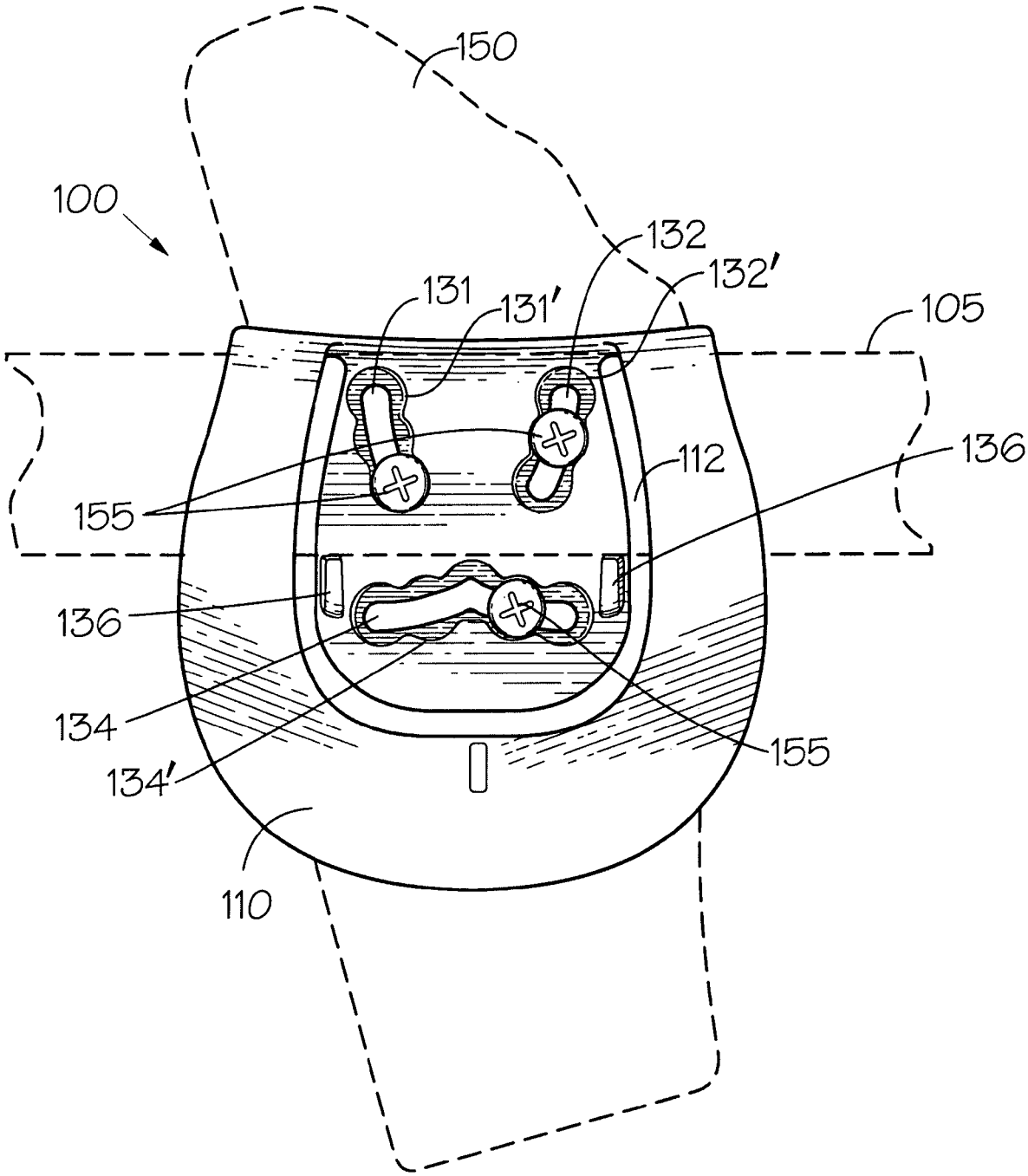
FIG. 2A shows a rear elevation view of the first exemplary embodiment of a paddle according to this invention, wherein an exemplary holster is attached to the exemplary paddle and the exemplary paddle is attached to an exemplary belt, as illustrated in phantom with broken lines.

As illustrated in FIG. 2A, clearly defined, optional fastener positioning indents 131', 132', and 134' are formed in the second side of the paddle attachment plate 130 in an area around the arcuate slots 131 and 132 and the compound slot 134, respectively. The fastener positioning indents 131', 132', and 134', if included, are formed so as to provide predefined or determined seating positions for a portion (i.e., the heads) of the fasteners 155.

Thus, incremental angles of an attached holster 150 relative to the paddle attachment plate 130 can be achieved by movement of the holster 150 relative to the paddle attachment plate 130, such that the fasteners 155 are seated in positions, which are predefined by the fastener positioning indents 131', 132', and 134'. Upon securing the holster 150 to the paddle attachment plate 130 (i.e., by tightening of the fasteners 155), the position of the holster 150 is fixed relative to the paddle attachment plate 130. Slippage of the secured fasteners 155 within the arcuate slots 131 and 132 and the compound slot 134 is precluded by the predefined fastener positioning indents 131', 132', and 134', respectively.

Depending on the relative sizes of the fastener head and the predefined fastener positioning indents 131', 132', and 134', each fastener 155 must either be loosened or completely removed prior to adjustment of the holster 150 from one position to another position.

Therefore, when the fasteners 155 are loosened or removed (if necessary), the holster 150 may be adjusted to assume a desired angle relative to the paddle attachment plate 130. That is to say, in various exemplary embodiments, the fasteners 155 in the arcuate slots 131 and 132 and in the compound slot 134 may be loosened and allowed to travel within the slots while the holster 150 is rotated relative to the paddle attachment plate 130. When the holster 150 has been rotated to a predetermined position, as defined by the predefined fastener positioning indents 131', 132', and 134', the fasteners 155 may be tightened or otherwise secured within the arcuate slots 131 and 132 and in the compound slot 134, such that the holster 150 is maintained in the predetermined position.

As further illustrated in FIG. 2A, the fastener positioning indents 131', 132', and 134' are formed so as to completely surround each of the arcuate slots 131 and 132 and the compound slot 134, respectively. However, it should be appreciated that, in various exemplary embodiments, the fastener positioning indents 131', 132', and 134' may only be formed along a portion of each of the arcuate slots 131 and 132 and the compound slot 134, respectively. For example, the fastener positioning indents 131', 132', and 134' may only be formed along one side of each of the arcuate slots 131 and 132 and the compound slot 134, respectively.

Figure 2B:
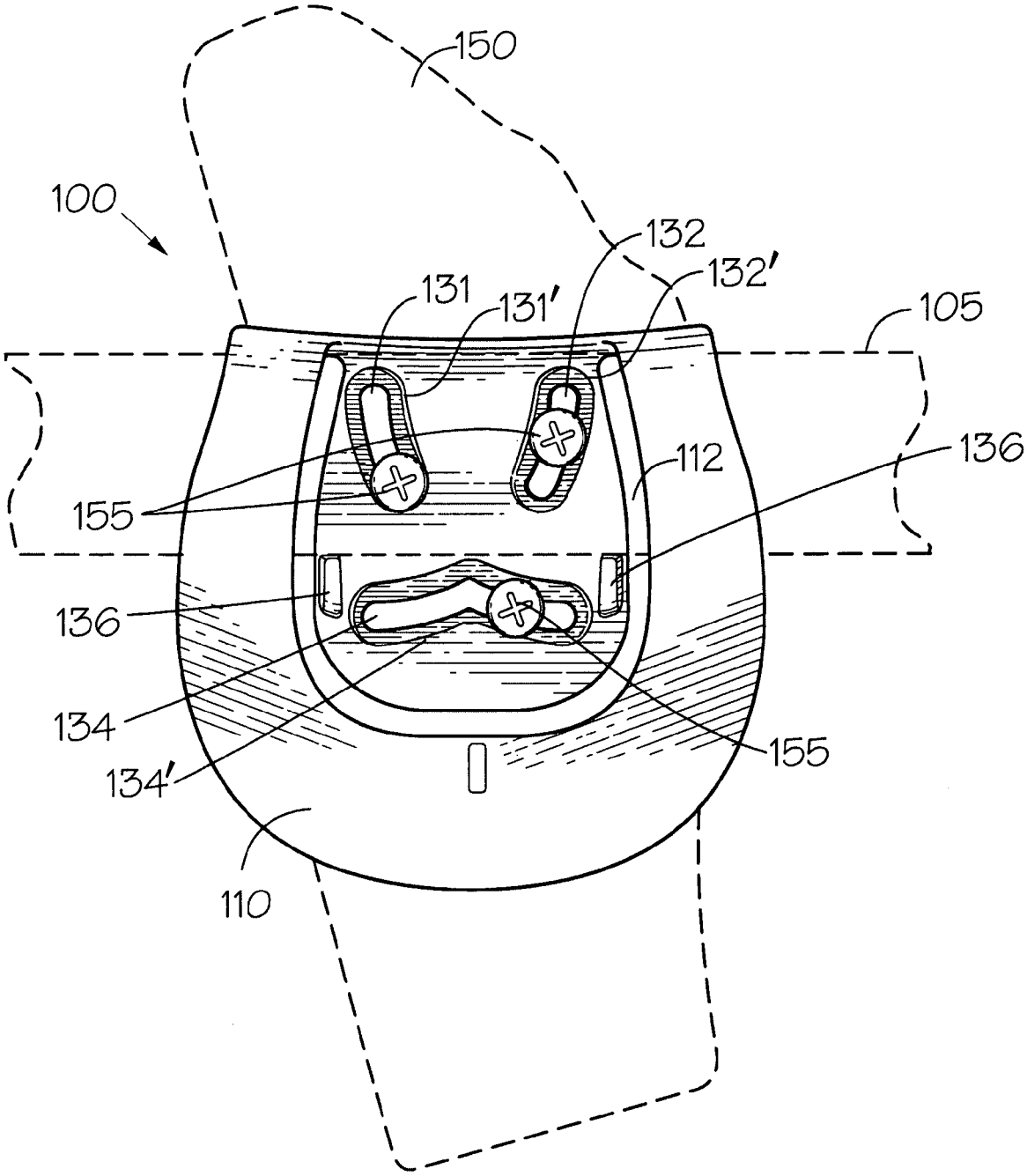
FIG. 2B shows a rear elevation view of an alternate exemplary embodiment of a paddle according to this invention, wherein an exemplary holster is attached to the exemplary paddle and the exemplary paddle is attached to an exemplary belt, as illustrated in phantom with broken lines.

As illustrated in FIG. 2B, the optional fastener positioning indents 131', 132', and 134' may optionally be formed so as to allow a portion of the fasteners 155 (i.e., the heads) to be positioned anywhere along the optional fastener positioning indents 131', 132', and 134', thereby provide for an infinite number of possible seating positions for the fasteners 155 within the optional fastener positioning indents 131', 132', and 134'.

Figure 2C:
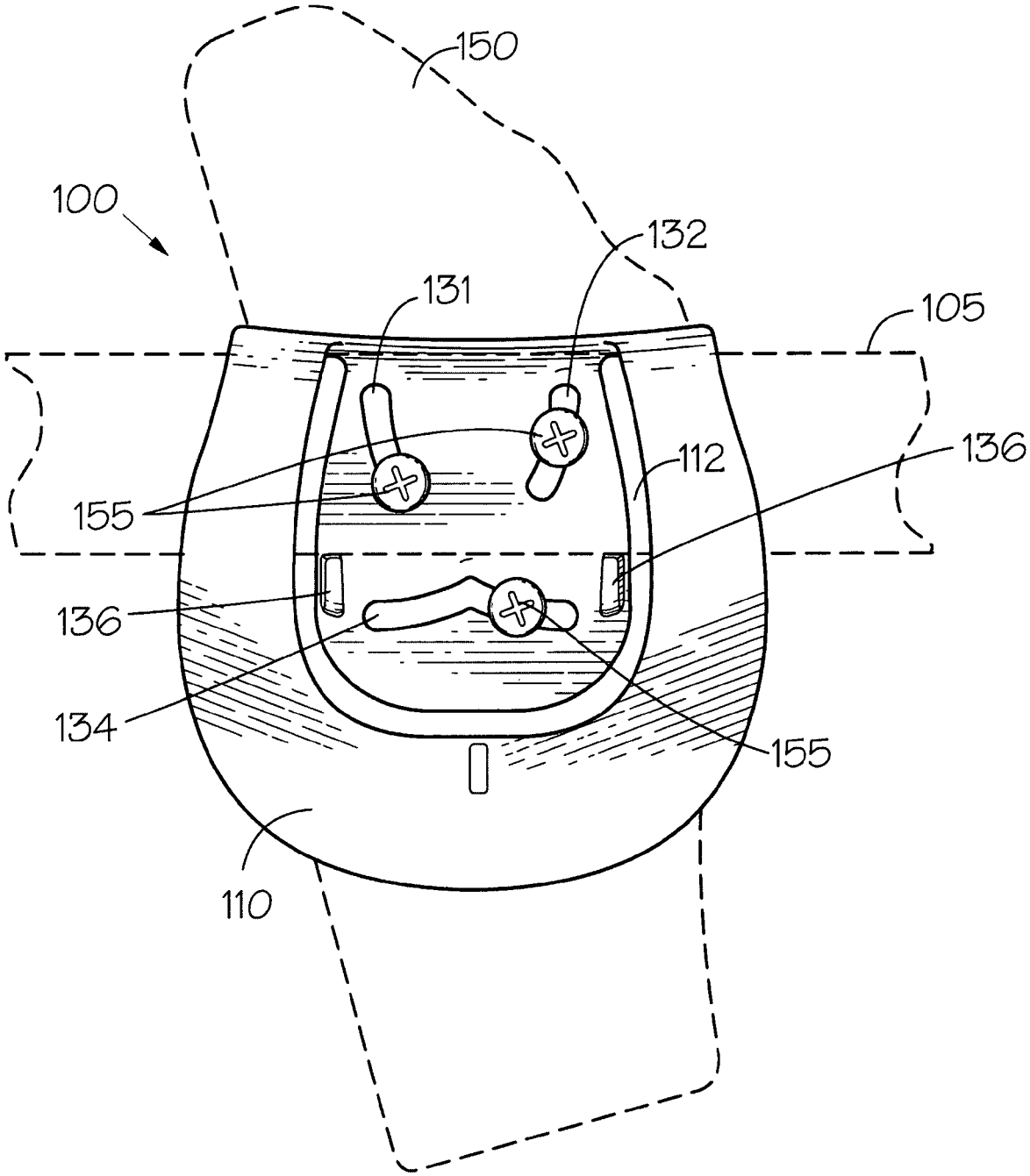
FIG. 2C shows a rear elevation view of an alternate exemplary embodiment of a paddle according to this invention, wherein an exemplary holster is attached to the exemplary paddle and the exemplary paddle is attached to an exemplary belt, as illustrated in phantom with broken lines.

As illustrated in FIG. 2C, the optional fastener positioning indents 131', 132', and 134' may not be included in the paddle attachment plate 130. It should be appreciated that if the optional fastener positioning indents 131', 132', and 134' are not be included, the fasteners 155 may be positioned anywhere along the arcuate slots 131 and 132 and the compound slot 134, thereby provide for an infinite number of possible seating positions for the fasteners 155 within the arcuate slots 131 and 132 and the compound slot 134.

As further illustrated in FIGS. 1-3B, a raised area 131", 132", and/or 134" is formed on the first side of the paddle attachment plate 130 in an area around each of the arcuate slots 131 and 132 and the compound slot 134, respectively. These raised areas 131", 132", and/or 134" may be formed so as to provide a clearance between the heads of the fasteners 155, when the fasteners 155 are seated within the fastener positioning indents 131', 132', and 134', and the body of the wearer. These raised areas may also be formed so as to compensate for a certain amount of curvature of the paddle attachment plate 130 and provide a more planar attachment face for attachment of the holster 150 to the paddle attachment plate 130.

In various exemplary embodiments, these raised areas 131", 132", and/or 134" may only be formed along a portion of one or more of the arcuate slots 131 and 132 and/or the compound slot 134. Alternatively, the paddle attachment plate 130 may not include any raised areas on its first side. Thus, having a raised area formed on the first side of the paddle attachment plate 130 in an area around one or more of the arcuate slots 131 and 132 and the compound slot 134 is optional and is not critical for practicing the invention.

In various exemplary embodiments, at least a portion of the paddle 100 is substantially rigid or semi-rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, and/or various combinations of the foregoing. Thus, it should be understood that the material or materials used to form the paddle 100 is a design choice based on the desired appearance and/or functionality of the paddle 100.

Figure 4:
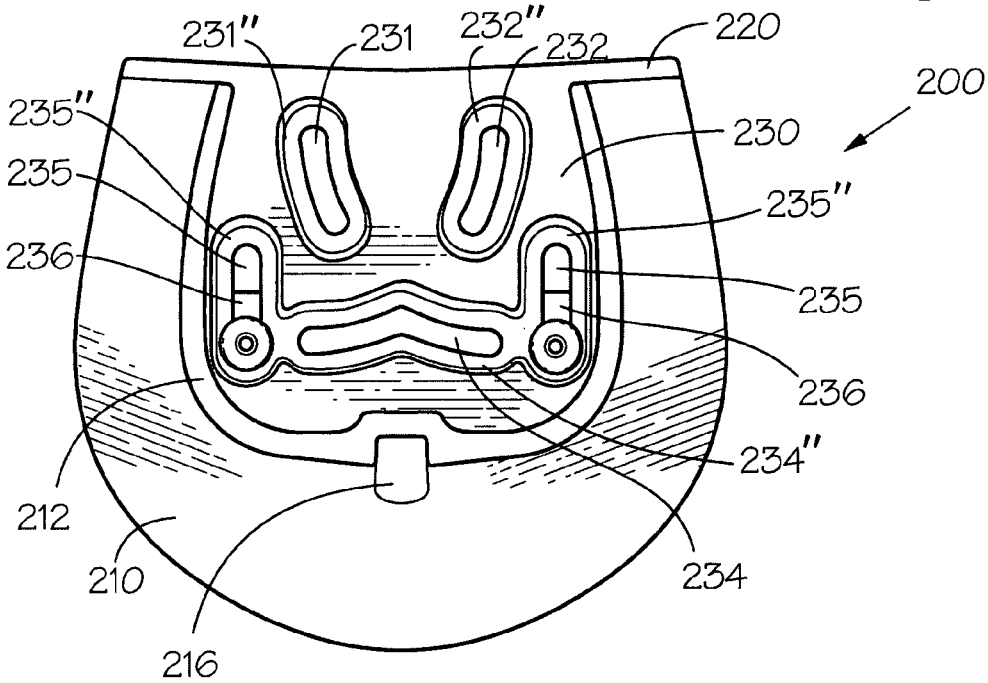
FIG. 4 shows a front elevation view of a second exemplary embodiment of a paddle according to this invention.
Figure 5:
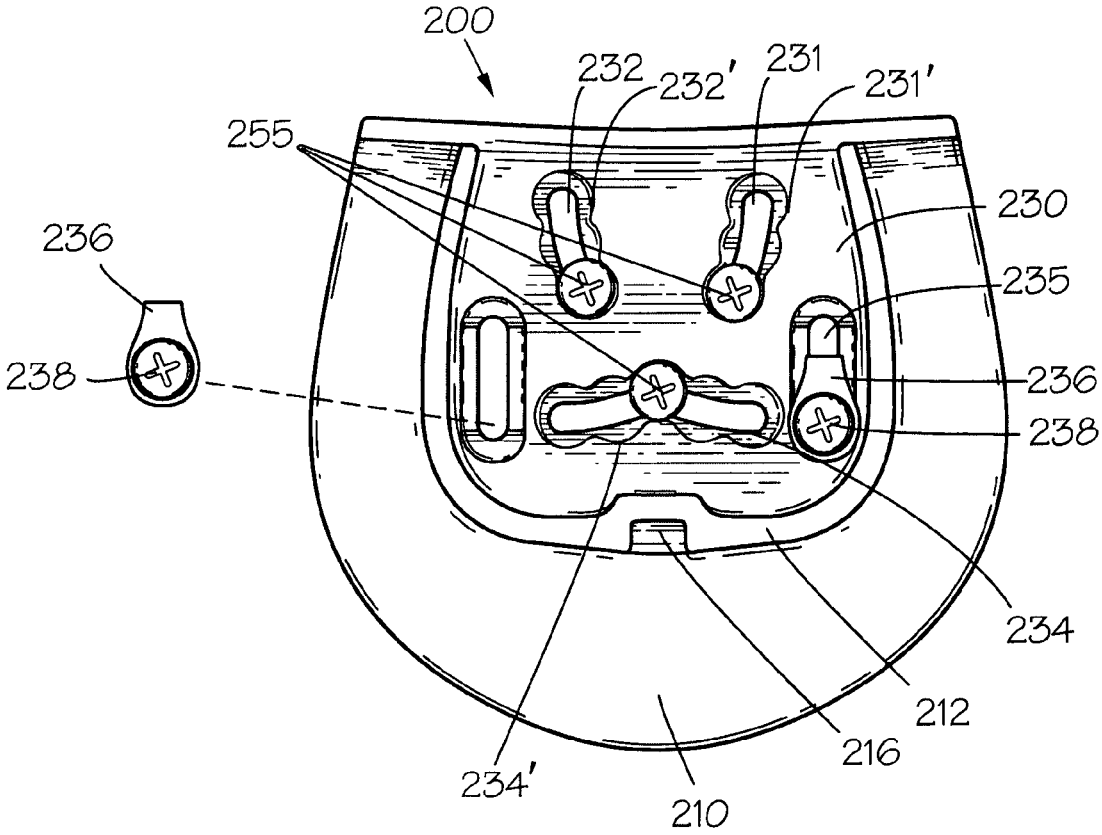
FIG. 5 shows a rear elevation view of an exemplary embodiment of a paddle according to this invention.
Figure 6A:
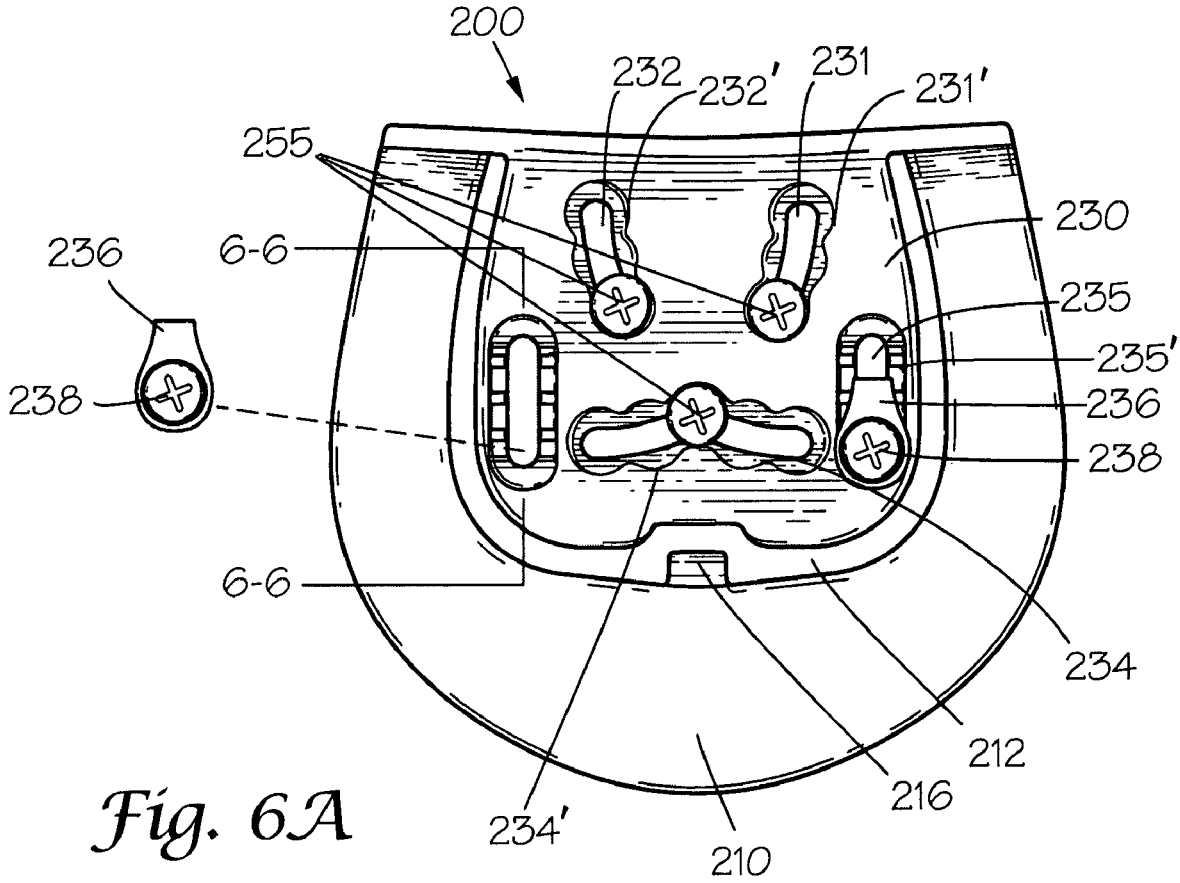
FIG. 6A shows a rear elevation view of an additional exemplary embodiment of a paddle according to this invention.
Figure 6B:
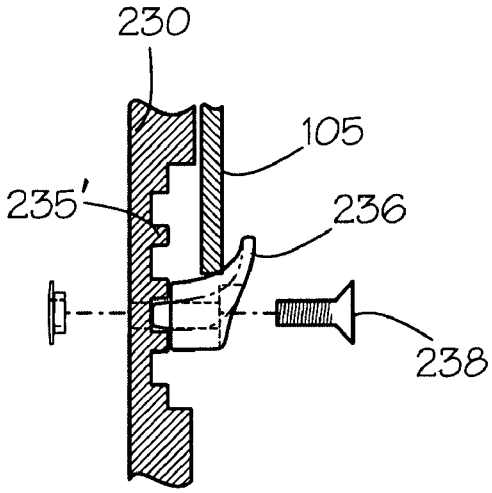
FIG. 6B shows a partial cross-sectional view, taken along line 6-6 of FIG. 6A of the second exemplary embodiment of a paddle according to this invention, and shows a more detailed view of the exemplary adjustable protrusion slot and adjustable protrusion of FIG. 6A.

FIG. 4 shows a front elevation view while FIGS. 5 and 6A show a rear elevation view of a second exemplary embodiment of a paddle 200 according to this invention. FIG. 6B shows a partial cross-sectional view, taken along line 6-6 of FIG. 6A, of the paddle 200. As shown in FIGS. 4-6B, the paddle 200 comprises a paddle extension 210 optionally having a skeletonized portion 212 and optionally including at least one paddle projection 216, a paddle bridge portion 220, a paddle attachment plate 230, an arcuate slot 231 having associated fastener positioning indents 231' and an raised area 231", an arcuate slot 232 having associated fastener positioning indents 232' and an raised area 232", a compound slot 234 having associated fastener positioning indents 234' and an raised area 234". The paddle 200 is operable to be attached or coupled (via fasteners 255 interacting with the arcuate slot 231, the arcuate slot 232, and the compound slot 234), to the holster 150, and (via the interaction of the paddle extension 210, the paddle bridge portion 220, and the paddle attachment plate 230), to the belt 105.

It should be understood that each of these elements may optionally correspond to and operate similarly to the paddle extension 110, the optional skeletonized portion 112, the optional at least one paddle projection 116, the paddle bridge portion 120, the paddle attachment plate 130, the arcuate slot 131, the fastener positioning indents 131' and the raised area 131", the arcuate slot 132, the fastener positioning indents 132' and the raised area 132", the compound slot 134, the fastener positioning indents 134' and the raised area 134", and the fasteners 155, as described herein with reference to the paddle 100.

However, as shown in FIGS. 4-6B, the at least one optional paddle protrusion 136, as described herein with reference to the paddle 100, is replaced by at least one removable, repositionable paddle protrusion 236 that is capable of being secured within at least one slot 235.

As shown in FIGS. 4-6B, one or more elongate slots 235 are formed through the paddle attachment plate 230. In various exemplary embodiments, at least two slots 235 are provided, which may essentially form mirror images of one another.

Each slot 235 is formed so as to be capable of receiving at least a portion of a repositionable paddle protrusion 236 and an associated fastener 238, which is capable of passing therethrough for securing the repositionable paddle protrusion 236 to the paddle attachment plate 230, as illustrated in FIGS. 4-6A.

As illustrated in FIG. 5, the slots 235, in cooperation with one or more appropriate fasteners 238, allow the repositionable paddle protrusion 236 to be attached to the paddle attachment plate 230 at any desired level. In this manner, the repositionable paddle protrusion(s) 236 may be positioned at a given height to better accommodate, for example, various widths of the belt 105.

Once secured to the paddle attachment plate 230, each of the repositionable paddle protrusions 236 extends from the second side wall of the paddle attachment plate 230 so as to form a catch or barb that provides a degree of additional resistance to the removal of the paddle 200 once the paddle 200 has been attached to a user's belt, waistband, or other article of clothing.

In various exemplary embodiments, the fasteners 238 may comprise screws, snap-together parts, or any other known or later developed means for removably attaching or coupling the repositionable paddle protrusions 236 within the slot 235 of the paddle attachment plate 230.

Alternatively, as illustrated in FIGS. 6A and 6B, optional protrusion positioning indents 235' are formed in the second side of the paddle attachment plate 230 in an area around the slots 235. The protrusion positioning indents 235', if included, are formed so as to provide predefined or determined seating positions for the repositionable paddle protrusions 236.

Thus, incremental change of the position of an attached repositionable paddle protrusion 236 may be made, along a respective slot 235, by movement of the repositionable paddle protrusion 236 along a respective slot 235, and positioning of the repositionable paddle protrusion 236 within one of the determined seating positions, as defined by the protrusion positioning indents 235'.

Once the repositionable paddle protrusion 236 is appropriately secured to the paddle attachment plate 230, by tightening, attaching, or coupling of the fastener(s) 238, the position of the repositionable paddle protrusion 236 is fixed. Slippage of the repositionable paddle protrusion 236 within the slot 235 is precluded by the protrusion positioning indents 235'. Depending on the relative sizes of the fastener head and the protrusion positioning indents 235', each fastener 238 must either be loosened or removed prior to adjustment of the repositionable paddle protrusion 236 from one position to another position.

In each case, a bottom portion of each of the repositionable paddle protrusions 236 is formed so as to be received in an appropriate mating relationship with the protrusion positioning indents 235'.

Therefore, when the fasteners 238 are loosened or removed (if necessary), the repositionable paddle protrusion 236 may be adjusted to assume a desired height and/or angle relative to the paddle attachment plate 230.

That is to say, in various exemplary embodiments, the fasteners 238 in the slots 235 may be loosened and allowed to travel within the slots 235, so that the repositionable paddle protrusions 236 may be repositioned along the slots 235. When the repositionable paddle protrusions 236 have been moved to a determined position, the fasteners 238 may be tightened within the slots 235, such that the repositionable paddle protrusions 236 are maintained in the of determined position.

As illustrated in FIGS. 6A and 6B, the protrusion positioning indents 235' are formed so as to completely surround each of the slots 235. However, it should be appreciated that, in various exemplary embodiments, the protrusion positioning indents 235' may only be formed along a portion of each of the slots 235. For example, the protrusion positioning indents 235' may only be formed along one side of each of the slots 235.

FIGS. 7-11 show various views of a third exemplary, non-limiting embodiment of a paddle 300 according to this invention. It should be appreciated that various exemplary embodiments of the paddle 300 are described and shown with reference to a handgun holster 150 (holster 150 is depicted in phantom with broken lines in FIG. 8) being attached to the paddle 300. However, it should be appreciated that one or more other accessory carriers (not shown) or mounting devices (not shown) may be attached to the paddle 300 in place of or in addition to a holster 150.

As shown in FIGS. 7-11, the paddle 300 comprises a paddle extension 310 optionally having a skeletonized portion 312 and optionally including at least one paddle projection 316, a paddle bridge portion 320, a paddle attachment plate 330, an arcuate slot 331 having associated fastener positioning indents 331' and an raised area 331", an arcuate slot 332 having associated fastener positioning indents 332' and an raised area 332", a compound slot 334 having associated fastener positioning indents 334' and an raised area 334", and at least one slot 335 having associated optional protrusion positioning indents 335'.

It should be understood that each of these elements may optionally correspond to and operate similarly to the paddle extension 210, the skeletonized portion 212, the at least one paddle projection 216, the paddle bridge portion 220, the paddle attachment plate 230, the arcuate slot 231 having the associated fastener positioning indents 231' and the raised area 231", the arcuate slot 232 having the associated fastener positioning indents 232' and the raised area 232", the compound slot 234 having the associated fastener positioning indents 234' and the raised area 234", and the at least one slot 235 having the associated optional protrusion positioning indents 235', as described herein with reference to the paddle 200.

Furthermore, it should be understood that the paddle 300 is operable to be attached or coupled (via fasteners 355 interacting with the arcuate slot 331, the arcuate slot 332, and the compound slot 334), to the holster 150, and (via the interaction of the paddle extension 310, the paddle bridge portion 320, and the paddle attachment plate 330), to the belt 105.

However, as shown in FIGS. 7-11, the at least one optional repositionable paddle protrusion 236, as described herein with reference to the paddle 200, is replaced by at least one removable, repositionable paddle protrusion 336 that is securable within the at least one slot 335.

As shown in FIGS. 7-11, unlike the repositionable paddle protrusion 236, the repositionable paddle protrusion 336 includes a substantially "T"-shaped protrusion 338 that extends from a bottom portion of the repositionable paddle protrusion 336.

Figure 11:
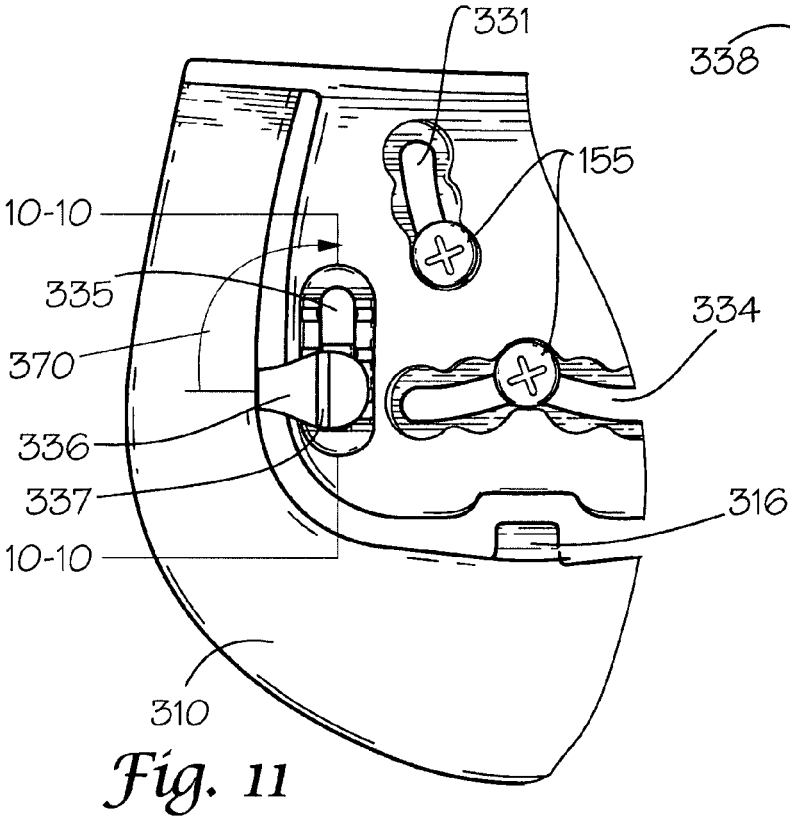
FIG. 11 shows a partial rear elevation view of the third exemplary embodiment of a paddle, and illustrates the third exemplary embodiment of an adjustable protrusion according to this invention, wherein the adjustable protrusion is illustrated in an un-locked position.

The "T"-shaped protrusion 338, is formed so as to allow the arms of the "T" portion to fit within the slot 335 when the repositionable paddle protrusion 336 is in the unlocked position, as illustrated in FIG. 11. When the repositionable paddle protrusion 336 is rotated into the locked position, as illustrated by the arch 370 in FIG. 11 and as also illustrated in FIGS. 7, 8, 9B and 10C, an inner surface of the "T" portion comes into frictional contact with the first side of the paddle attachment plate 330, and secures the repositionable paddle protrusion 336 within the slot 335.

Thus, the "T"-shaped protrusion 338 of the repositionable paddle protrusion 336 allows the repositionable paddle protrusion 336 to be secured within the slot 335 without the need of a separate fastener, such as the fastener 238.

Figure 10A:
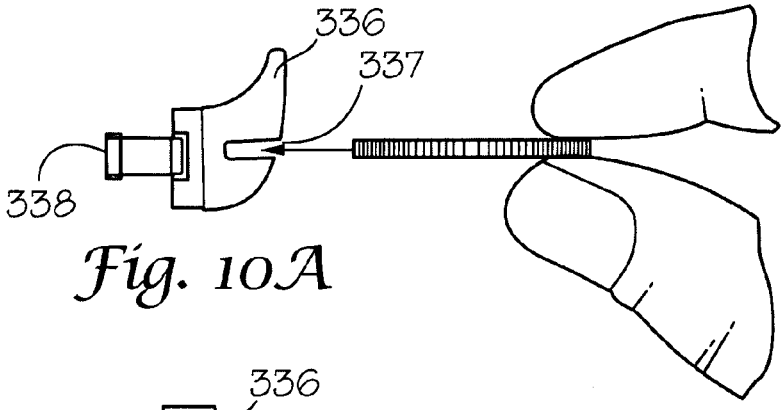
FIG. 10A shows a side elevation view of the third exemplary embodiment of an adjustable protrusion.
Figure 10B:
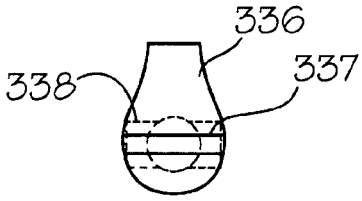
FIG. 10B shows a front elevation view of the third exemplary embodiment of an adjustable protrusion.
Figure 10C:
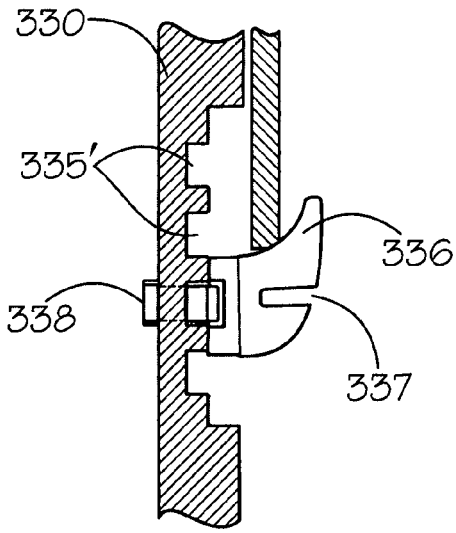
FIG. 10C shows a partial cross-sectional view, taken along line 10-10 of FIG. 11 of the third exemplary embodiment of the paddle, and shows a more detailed view of the third exemplary adjustable protrusion in a locked position.

In various exemplary embodiments, the repositionable paddle protrusion 336 also includes an optional slot 337, which is capable of accepting a portion of a coin (as illustrated in FIG. 10A) or other object so as to allow a user to exert increased rotational force on the repositionable paddle protrusion 336 and aid in rotating the repositionable paddle protrusion 336 from a locked to an unlocked position, or vice versa.

Figure 7:
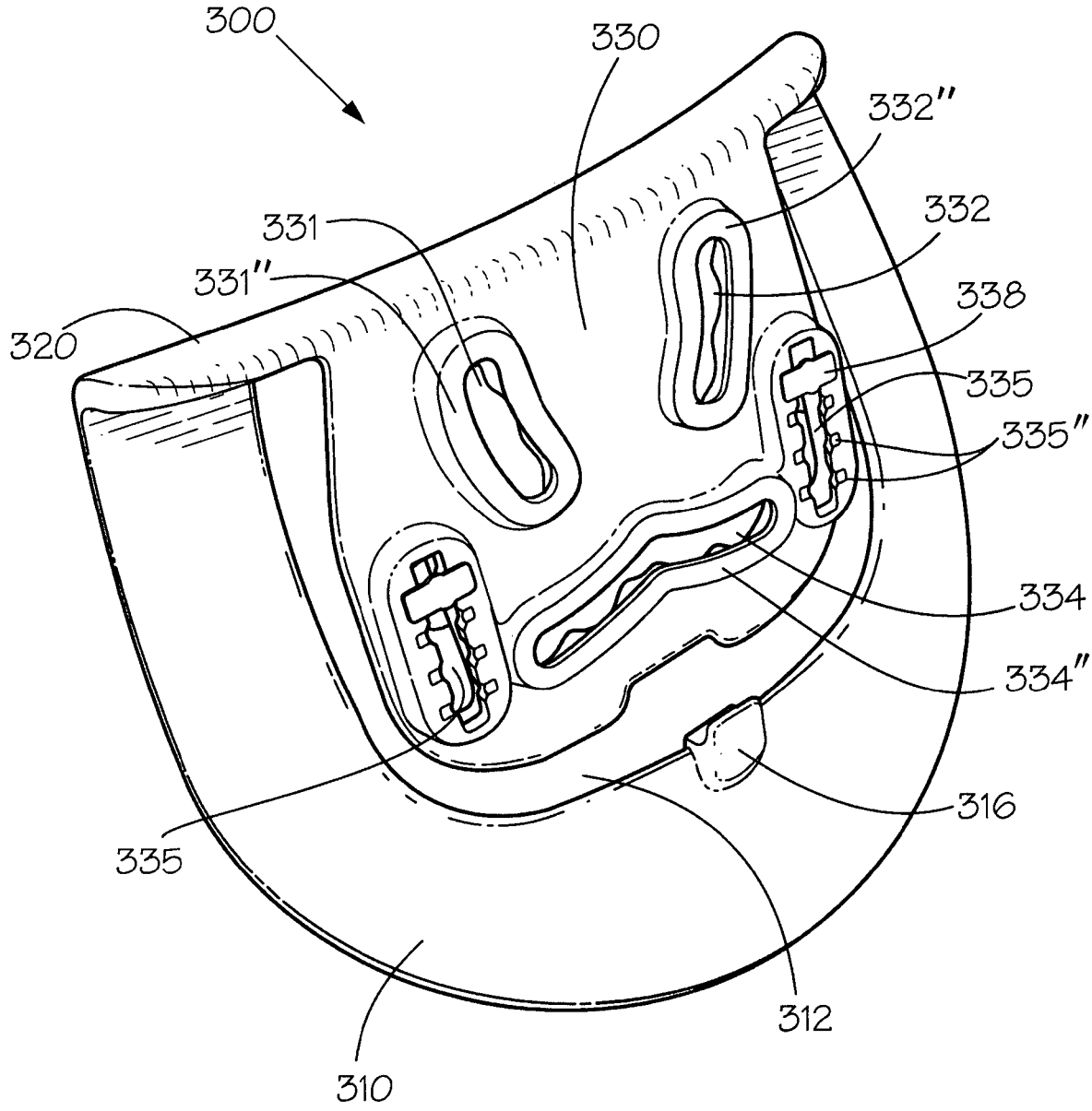
FIG. 7 shows a front perspective view of a third exemplary embodiment of a paddle according to this invention.

Additionally, as illustrated in FIG. 7, optional transverse positioning indents 335" may be formed in the first side of the paddle attachment plate 330 in an area around the slots 335. The transverse positioning indents 335", if included, are formed so as to provide an additional surface preparation for maintaining the repositionable paddle protrusions 336 in a locked position.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A paddle for securing at least one holster or accessory carrier at a desired attitude or angle, comprising:

an attachment plate;

a first arcuate slot defined through the attachment plate, wherein the first arcuate slot is capable of allowing a first fastening means to extend therethrough;

a second arcuate slot defined through the attachment plate, wherein the second arcuate slot is capable of allowing a second fastening means to extend therethrough;

a compound slot defined through the attachment plate below the first and second slots, the compound slot comprising a slot formed by the intersection of two arcuate slots, wherein the arc centers of the two arcuate slots are located above the compound slot, wherein a point of intersection of the two arcuate slots forms the highest point of the compound slot, and wherein the compound slot is capable of allowing a third fastening means to extend therethrough;

wherein the fastening means are capable of extending through the first arcuate slot, the second arcuate slot, or the compound slot to engage points of attachment defined on the holster or accessory carrier;

and wherein a relative angle of the holster or accessory carrier to the attachment plate is adjustable by coordinated adjustment of the fastening means within the first arcuate slot, the second arcuate slot, or the compound slot; and a paddle extension portion, wherein the attachment plate is coupled to the paddle extension via a paddle bridge portion.

2. The paddle of claim 1, wherein the paddle extension is capable of being affixed in a clip-on manner, when positioned between a user's body and a user's waistband/belt.

3. The paddle of claim 1, wherein the first arcuate slot and the second arcuate slot are formed in an upper portion of the paddle attachment plate.

4. The paddle of claim 1, wherein the first arcuate slot and the second arcuate slot form mirror images of one another.

5. The paddle of claim 1, wherein the compound slot is formed in a lower portion of the paddle attachment plate.

6. The paddle of claim 1, wherein the paddle extension comprises a curved portion of material.

7. The paddle of claim 1, wherein the paddle extension includes a skeletonized portion, wherein the skeletonized portion comprises an aperture formed in the paddle extension.

8. The paddle of claim 1, wherein the paddle extension includes at least one paddle projection extending from a first side wall of the paddle extension.

9. The paddle of claim 1, wherein the paddle bridge portion comprises an extended portion of the paddle extension or the paddle attachment plate.

10. The paddle of claim 1, wherein the paddle bridge portion comprises a separate component that is joined, attached, coupled, welded, or fused to join the paddle extension to the paddle attachment plate.

11. The paddle of claim 1, wherein the paddle extension and the paddle attachment plate are formed of a single portion of material in which a substantially "U"-shaped slot is formed to define the paddle extension and the paddle attachment plate.

12. The paddle of claim 1, wherein the paddle extension is formed relative to the paddle attachment plate in a spring biased manner, such that at least a portion of the paddle extension, the paddle bridge portion, or the paddle attachment plate must be flexed in order for the paddle extension to be positioned between a user's body and the user's waistband/belt.

13. The paddle of claim 1, wherein the paddle attachment plate includes at least one paddle protrusion that extends from a second side wall of the paddle attachment plate.

14. The paddle of claim 1, wherein the paddle attachment plate includes defined fastener positioning indents formed in the second side of the paddle attachment plate in an area around at least a portion of at least one of the first arcuate slot, the second arcuate slot, and the compound slot, so as to provide determined seating positions for a portion of the fastening means, such that the holster or accessory carrier is adjustable to predefined angles based upon the positioning of the fastening means in selected fastener positioning indents.

15. The paddle set forth in claim 14, wherein the fastening means comprise screws and wherein the selected indents formed in the attachment plate engage a head portion of the screws.

16. The paddle of claim 14, wherein the fastener positioning indents are formed so as to completely surround each of the first arcuate slot, the second arcuate slot, and the compound slot.

17. The paddle of claim 14, wherein the fastener positioning indents are formed around a portion of each of the first arcuate slot, the second arcuate slot, and the compound slot.

18. The paddle of claim 1, wherein a raised area is formed on the first side of the paddle attachment plate in an area around at least one of the first arcuate slot, the second arcuate slot, and the compound slot.

19. The paddle of claim 1, wherein the paddle attachment plate comprises at least one elongate slot formed through the paddle attachment plate, wherein each elongate slot is formed so as to be capable of receiving a repositionable paddle protrusion at one of a number of determined positions along the elongate slot.

20. The paddle of claim 19, wherein the paddle attachment plate includes defined protrusion positioning indents formed in an area around each elongate slot, so as to provide determined positions for the repositionable paddle protrusions.

21. The paddle of claim 19, wherein each repositionable paddle protrusion is attachable to an elongate slot by a fastening means.

22. The paddle of claim 19, wherein each repositionable paddle protrusion is attachable to an elongate slot by a substantially "T"-shaped protrusion that extends from the repositionable paddle protrusion, wherein each "T"-shaped protrusion is formed such that, when each repositionable paddle protrusion is rotated to a locked position, an inner surface of the "T"-shaped protrusion comes into frictional contact with the first side of the paddle attachment plate and secures the repositionable paddle protrusion within the slot.

23. The paddle of claim 22, wherein each repositionable paddle protrusion includes a slot, which is capable of accepting a portion of a an object so as to allow a user to exert increased rotational force on the repositionable paddle protrusion and aid in rotating the repositionable paddle protrusion.

* * * * *